US007357524B2

(12) United States Patent
Booty, Jr.

(10) Patent No.: US 7,357,524 B2
(45) Date of Patent: Apr. 15, 2008

(54) HOUSEHOLD COMPONENT PASSIVE ILLUMINATOR

(76) Inventor: Donald J. Booty, Jr., 5522 E. Dusty Wren Dr., Cave Creek, AZ (US) 85331

( * ) Notice: Subject to any disclaimer, the term of this patent is extended or adjusted under 35 U.S.C. 154(b) by 4 days.

(21) Appl. No.: 10/976,545

(22) Filed: Oct. 29, 2004

(65) Prior Publication Data

US 2006/0092620 A1 May 4, 2006

(51) Int. Cl.
*F05B 17/10* (2006.01)

(52) U.S. Cl. ..... 362/100; 362/84; 362/253

(58) Field of Classification Search ..... 362/100, 362/84, 253

See application file for complete search history.

(56) References Cited

U.S. PATENT DOCUMENTS

| | | | | |
|---|---|---|---|---|
| 2,503,044 | A * | 4/1950 | Guerra | 250/466.1 |
| 2,566,490 | A | 9/1951 | Heinz | |
| 4,767,477 | A | 8/1988 | Danjell | |
| 4,806,723 | A | 2/1989 | Beynon et al. | |
| 4,914,554 | A | 4/1990 | Sowers | |
| 4,927,015 | A | 5/1990 | Jones | |
| 5,008,551 | A | 4/1991 | Randolph | |
| 5,162,160 | A | 11/1992 | Matsui et al. | |
| D346,406 | S * | 4/1994 | Pennington | D20/42 |
| 5,807,156 | A | 9/1998 | Owen | |
| 6,100,650 | A | 8/2000 | Yokozeki et al. | |
| 6,132,057 | A * | 10/2000 | Williams | 362/100 |
| 6,461,012 | B1 * | 10/2002 | Shuman | 362/100 |
| 2002/0132135 | A1 | 9/2002 | Sturley | |
| 2003/0231508 | A1 | 12/2003 | Ramamurthy et al. | |

FOREIGN PATENT DOCUMENTS

| | | | |
|---|---|---|---|
| FR | 2632000 | A1 | 12/1989 |

* cited by examiner

*Primary Examiner*—Thomas M. Sember

(57) ABSTRACT

A passive illuminator that is configured to releasably engage the outer peripheral surface of a household component includes a main body having first and second ends, and inner and outer peripheral surfaces. The main body is configured such that the first and second ends are movable with respect to one another upon application of an external force to the main body. When the external force is not applied the first and second ends are disposed at least proximate one another, and the main body inner peripheral surface is dimensioned to releasably engage an outer peripheral surface of the household component.

18 Claims, 4 Drawing Sheets

HOUSEHOLD COMPONENT PASSIVE ILLUMINATOR

TECHNICAL FIELD

The present invention relates to passively luminescent devices and, more particularly, to a passively luminescent device that is configured to releasably engage a household component such as, for example, a door knob plate.

BACKGROUND

There are numerous accounts of individuals becoming disoriented in a darkened room and being unable, or finding it fairly difficult, to exit the room or enter another. For example, a common occurrence experienced by many people involves rising at night to use the bathroom, attempting to locate the door to the room without turning on the room or hallway light and possibly waking a sleeping partner. In other examples, electrical power service may be lost and one or more rooms may thus be darkened. In many commercial settings, emergency lighting may be provided. However, in most residential homes, emergency lighting for such circumstances is typically not provided. Moreover, even if non-emergency light is available, power to the lights in such circumstances may not be available, as noted above.

A less drastic scenario of fear or disorientation may be in a child's room, which may be relatively dark at night. Many children, especially fairly young children, are frightened in a relatively dark room, or may become disoriented if they need to exit the room for various reasons, both emergency and non-emergency, during the night. In many instances, to alleviate this concern, a night-light may be placed in the child's room that partially illuminates the room and/or other parts of the darkened home. Similar concerns may also exist for the elderly.

While fairly effective for the desired purpose, night-lights do suffer certain drawbacks. For example, most night-lights rely on electrical power to operate, and thus increase household electrical expense. In addition, night-lights, even at low levels of illumination, are sometimes distracting to people who desire near total darkness for sleep. Moreover, in certain emergency situations, electrical power may not be available to energize the night-light.

Hence, there is a need for a device that will passively illuminate at least a small area or household component in a darkened room. That is, a device that will illuminate without the need to rely on a source of electrical power. The present invention addresses at least this need.

BRIEF SUMMARY

The present invention provides a device that passively illuminates a small area or the area around a household component in a darkened room.

In one embodiment, and by way of example only, a device for passively illuminating a household component includes a main body formed at least partially of a passively luminescent polymer material. The main body has a first end, a second end, an inner peripheral surface, and an outer peripheral surface. The main body is configured such that the first and second ends are movable with respect to one another upon application of an external force to the main body. When the external force is not applied the first and second ends are disposed at least proximate one another, and the main body inner peripheral surface is dimensioned to releasably engage an outer peripheral surface of the household component.

In yet another exemplary embodiment, a device for passively illuminating a household component includes a main body formed of a material that exhibits part memory and at least partially of a passively luminescent material. The main body has a first end, a second end, an inner peripheral surface, and an outer peripheral surface. The main body first end and a second ends are movable with respect to one another upon application of an external force to the main body. When the external force is not applied the first and second ends are disposed at least proximate one another, and the main body inner peripheral surface is dimensioned to releasably engage an outer peripheral surface of the household component.

In still another exemplary embodiment, a device for passively illuminating a door knob includes a main body formed of a material that exhibits part memory and at least partially of a passively luminescent material. The main body has a first end, a second end, an inner peripheral surface, and an outer peripheral surface. The main body first end and a second ends are movable with respect to one another upon application of an external force to the main body. When the external force is not applied the first and second ends are disposed at least proximate one another, and the main body inner peripheral surface is dimensioned to releasably engage an outer peripheral surface of the door knob plate.

These and other features and advantages of the preferred passive illuminator will become apparent from the following detailed description taken in conjunction with the accompanying drawings which illustrate, by way of example, the principles of the invention.

DETAILED DESCRIPTION OF PREFERRED EMBODIMENTS

Figure 1:
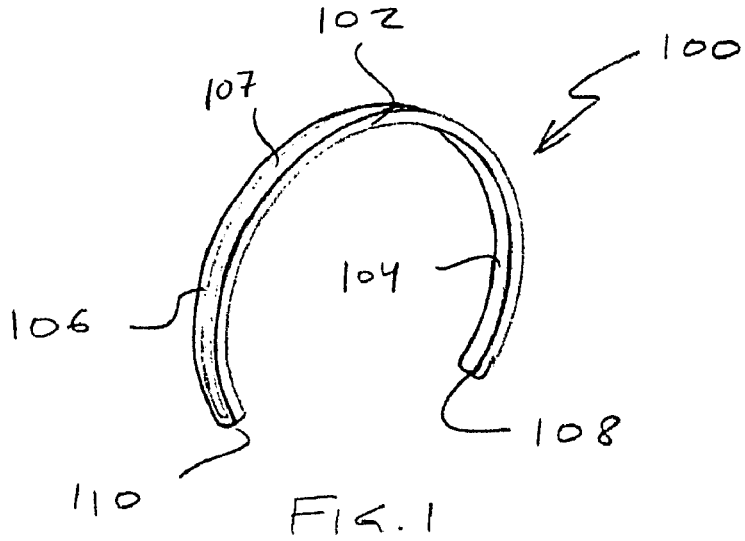
FIG. 1 is a perspective view of a passively luminescent device according to an exemplary embodiment of the present invention.
Figure 2:
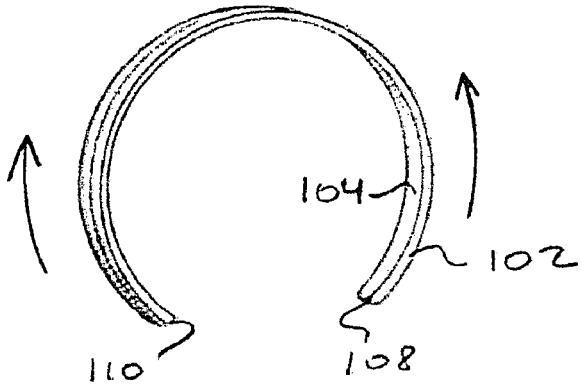
FIG. 2 is a perspective view of the device shown in FIG. 1 with an external force being applied thereto.

A perspective view of a particular preferred embodiment of a passively luminescent device 100 according to the present invention is shown in FIG. 1. The device 100, at least in the depicted embodiment, includes a ring-shaped main body 102, having an inner peripheral surface 104, an outer peripheral surface 106, a first end 108, and a second end 110. The main body 102 is preferably formed of any one of numerous materials that exhibit so-called "part memory." That is, as is shown more clearly in FIG. 2, the main body 102 will at least partially deform upon application thereto of an external force, but will return substantially to the original shape, shown in FIG. 1, upon release of the external force.

Any one of numerous materials that exhibit this behavior may be used to implement the main body 102 including, for example, any one of numerous polymers, spring steel, aluminum, or any one of numerous metal alloys.

The main body 102 is also configured to passively illuminate upon being exposed to a light source. This passive luminescence, or "glow-in-the-dark" capability, may be implemented in any one of numerous ways. For example, in the depicted embodiment, the main body 102 is formed at least partially of a passively luminescent material. More specifically, in a preferred embodiment, in which the main body is formed of a polymer, the passively luminescent material is mixed with the polymer, to thereby provide a fairly uniform luminance from the main body 102. Any one of numerous phosphors may be used for this purpose. Non-limiting examples of such phosphors include zinc sulfide and strontium aluminate. In other embodiments, the passively luminescent material such as, for example, a phosphor impregnated tape, paint, or coating, is applied, or otherwise coupled, to all, or portions of, the main body 102.

Figure 3:
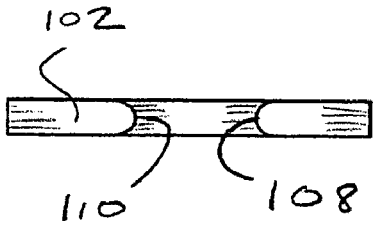
FIG. 3 is a side view of a portion of the device shown in FIG. 1.
Figure 7:
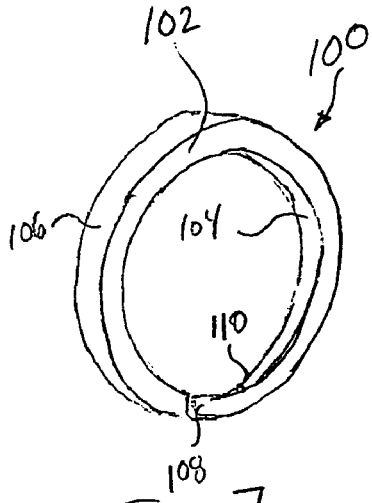
FIG. 7 is a perspective view of a passively luminescent device according to an exemplary alternative embodiment of the present invention.
Figure 8:
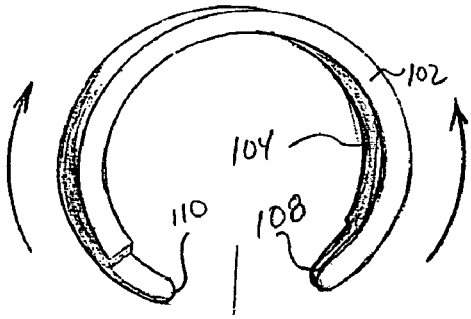
FIG. 8 is a perspective view of the device shown in FIG. 7 with an external force being applied thereto.
Figure 9:
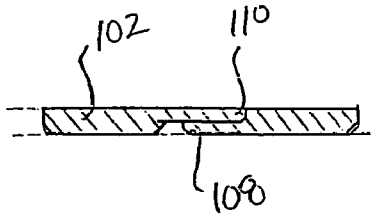
FIG. 9 is a side view of a portion of the device shown in FIG. 7.

The main body 102 is configured such that the first and second ends 108, 110 are disposed at least proximate one another when an external force is not applied. In the embodiment shown in FIG. 3, the first and second ends 108, 110 are spaced apart from one another. It will be appreciated that this is merely exemplary of a preferred embodiment, and that the device 100 could be configured such that the first and second ends 108, 110 at least partially overlap, and even engage, one another when an external force is not applied. In such an alternative embodiment, which is shown more clearly in FIGS. 7-9, the device 100 is configured such that when the ends 108, 110 overlap, the device 100 will exhibit a substantially uniform thickness when the external force is not applied.

The device 100 depicted in FIGS. 1-3 and FIGS. 7-9, may be either placed on a surface, hung on a flange or other extension, or hung around a door knob. However, in a particular preferred embodiment, as is shown in FIGS. 4-6 and 10-12, respectively, the device 100 is configured to be releasably coupled to a door knob plate 402. In particular, the main body inner peripheral surface 104 is dimensioned to be substantially equivalent to, or preferably slightly less than, the diameter of an outer peripheral surface 404 of the door knob plate 402. No matter the specific dimensions of the main body inner peripheral surface 104, it will be appreciated that it is dimensioned such that the device 100 releasably engages the door knob plate outer peripheral surface 404.

Figure 4:
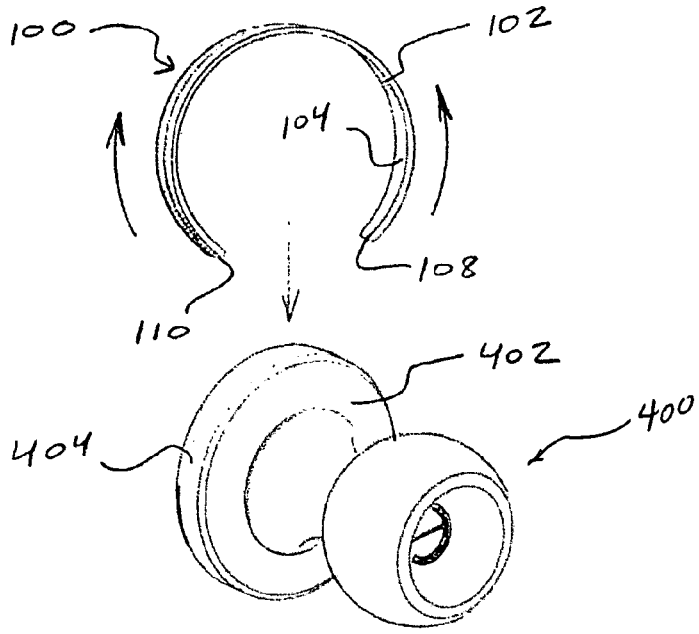
FIGS. 4-6 illustrate the device shown in FIGS. 1-3 installed, or being installed, on a door knob plate.
Figure 5:
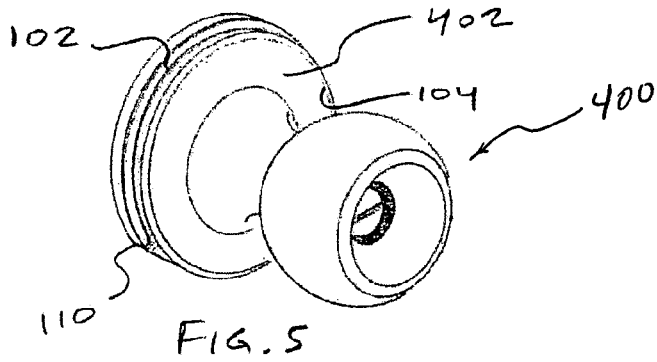
Figure 6:
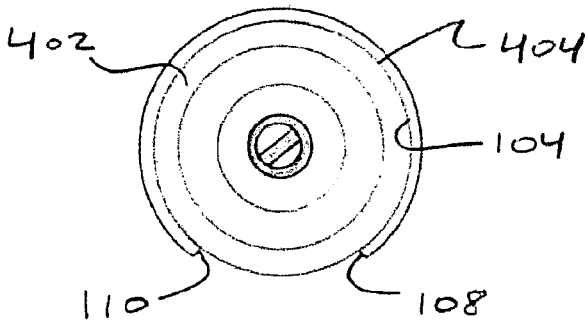
Figure 10:
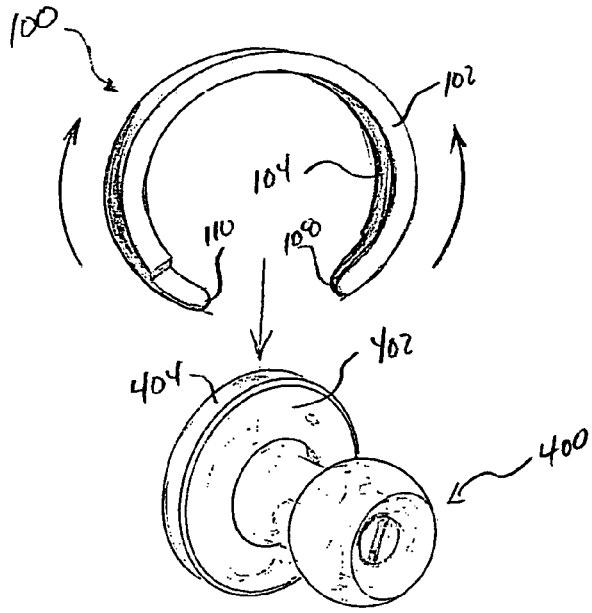
FIGS. 10-12 illustrate the device shown in FIGS. 7-9 installed, or being installed, on a door knob plate.
Figure 11:
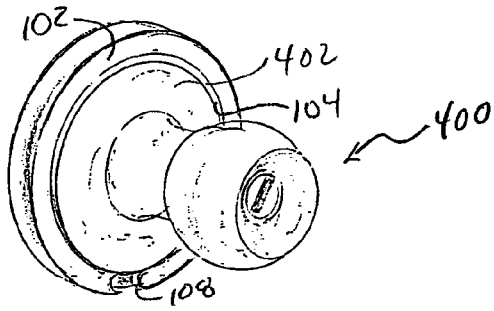
Figure 12:
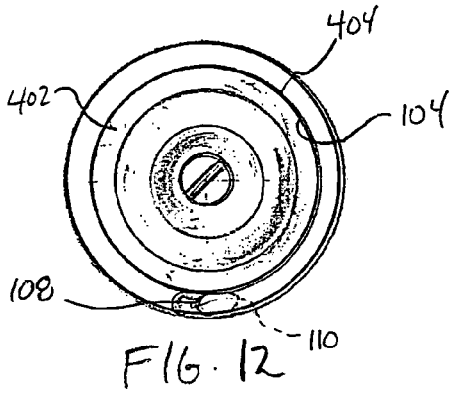

In order to install the device 100 on the door knob plate 402, a user need only apply an external force to the main body 100 to slightly separate the first and second ends 108, 110, as shown in FIGS. 4 and 10. The device 100 may then be disposed around the door knob plate 402, and the external force released. Upon release of the external force, as shown in FIGS. 5, 6, 11 and 12, the device 100 engages the door knob plate 402, and will remain there until removed by the user, or some other person.

The device 100 described above will, upon being exposed for a time period, passively illuminate to provide a lighted marker for the location of at least the door knob 400, and in some instances the area around the door knob 400. The amount of time the device 100 will need to be exposed to a light source, which may be either natural or artificial, will vary depending on the amount and type of luminescent material used, as will the amount of luminescence the device 100 supplies. In either case, the device 100 will provide some means of passive luminence in a darkened room.

It will be appreciated that the device 100 described above is not limited to a ring shape, but could take on any one of numerous shapes. Moreover, the device 100 is not limited to being configured to releasably engage a door knob plate 402, but could also be configured to releasably engage the outer peripheral surface of various other household components including, for example, a switch plate.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A device for passively illuminating a household component, comprising:

a household component; and a main body formed at least partially of a passively luminescent material, the main body having a first end, a second end, an inner peripheral surface, and an outer peripheral surface, wherein:

the main body is configured such that the first and second ends are movable with respect to one another upon application of an external force to the main body, and the main body is dimensioned such that when the external force is not applied:

(i) the first and second ends are spaced apart from one another, (ii) the first and second ends do not engage other portions of the main body, and (iii) an entirety of the main body inner peripheral surface releasably, and non-adhesively, contacts a substantial outer peripheral surface of the household component.

2. The device of claim 1, wherein the main body is substantially ring-shaped when the external force is not applied.

3. The device of claim 1, wherein the main body is formed at least in part of the passively luminescent polymer.

4. The device of claim 3, wherein the phosphor is strontium aluminate.

5. The device of claim 1, wherein:

the main body is formed at least in part of a metal; and the passively luminescent material is applied thereto.

6. The device of claim 1, wherein the passively luminescent material comprises a phosphor, whereby at least a portion of the main body is passively luminescent.

7. The device of claim 5, wherein the phosphor is zinc sulfide.

8. The device of claim 1, wherein the household component is a door knob plate.

9. The device of claim 1, wherein the household component is a switch plate.

10. The device of claim 1, wherein the main body is formed of a material that exhibits part memory.

11. A device for passively illuminating a household component, comprising:

a household component; and a main body formed (i) of a material that exhibits part memory and (ii) at least partially of a passively luminescent material, the main body having a first end, a second end, an inner peripheral surface, and an outer peripheral surface, wherein:

the main body is configured such that the first and second ends are movable with respect to one another upon application of an external force to the main body, and the main body is dimensioned such that when the external force is not applied:

(i) the first and second ends are spaced apart from one another, (ii) the first and second ends do not engage other portions of the main body, and (iii) an entirety of the main body inner peripheral surface releasably, and non-adhesively, contacts a substantial outer peripheral surface of the household component.

12. The device of claim 11, wherein the main body is substantially ring-shaped when the external force is not applied.

13. The device of claim 11, wherein the passively luminescent material comprises a phosphor.

14. The device of claim 13, wherein the phosphor is zinc sulfide.

15. The device of claim 13, wherein the phosphor is strontium aluminate.

16. The device of claim 11, wherein the household component is a door knob plate.

17. The device of claim 11, wherein the household component is a switch plate.

18. A device for passively illuminating a door knob, comprising:

a household component; and a ring shaped main body formed of (i) a material that exhibits part memory and (ii) at least partially of a passively luminescent material, the main body having a first end, a second end, an inner peripheral surface, and an outer peripheral surface, wherein:

the main body is configured such that the first and second ends are movable with respect to one another upon application of an external force to the main body, and the main body is dimensioned such that when the external force is not applied:

(i) the first and second ends are spaced apart from one another, (ii) the first and second ends do not engage other portions of the main body, and (iii) an entirety of the main body inner peripheral surface releasably, and non-adhesively, contacts a substantial outer peripheral surface of the household component.

* * * * *